US007029335B2

(12) United States Patent
Osada

(10) Patent No.: US 7,029,335 B2
(45) Date of Patent: Apr. 18, 2006

(54) ELECTRICAL CONNECTING DEVICE

(75) Inventor: Tsuyoshi Osada, Aichi (JP)

(73) Assignee: J.S.T. Corp., (JP)

( * ) Notice: Subject to any disclaimer, the term of this patent is extended or adjusted under 35 U.S.C. 154(b) by 0 days.

(21) Appl. No.: 11/101,385

(22) Filed: Apr. 7, 2005

(65) Prior Publication Data

US 2005/0239323 A1 Oct. 27, 2005

(30) Foreign Application Priority Data

Apr. 7, 2004 (JP) ..... P2004-113477
Jun. 28, 2004 (JP) ..... P2004-189162

(51) Int. Cl.
*H01R 13/04* (2006.01)

(52) U.S. Cl. ..... 439/694; 439/881; 439/902; 439/466; 439/468

(58) Field of Classification Search ..... 439/694, 439/881, 902, 466, 468
See application file for complete search history.

(56) References Cited

U.S. PATENT DOCUMENTS 5,288,242 A * 2/1994 Muzslay ..... 439/349
5,746,618 A * 5/1998 Gauker ..... 439/352
6,250,952 B1 * 6/2001 Shiga et al. ..... 439/466
6,666,708 B1 * 12/2003 Saito ..... 439/466
6,837,745 B1 * 1/2005 Takada et al. ..... 439/595

* cited by examiner

*Primary Examiner*—Tho D. Ta
(74) *Attorney, Agent, or Firm*—Osha Liang LLP

(57) ABSTRACT

Terminal connecting parts 15 that are connected to to-be-connected terminals 14, wire connecting part 16 at the ends on the side opposite terminal connecting parts 15, and bent parts 17 formed between terminal connecting parts 15 and wire connecting parts 16 are provided in connection terminals 11 of four or more poles. A connecting housing element 12 is provided with terminal supporting parts 22 for supporting respective connection terminals 11 in a manner where respective terminal connecting parts 15 are placed in a parallel manner in rectilinear form, so as to be connected to respective to-be-connected terminals 14. A cover element 13 is attached to connecting housing element 12 so as to cover connection terminals 11, and is provided with a rounded lid part in circular arc form. Wires 3 are arranged in the direction parallel to the direction in which terminal connecting parts 15 are arranged in rectilinear form. Connecting housing element 12 is engaged with and connected to a to-be-connected housing element 2.

15 Claims, 13 Drawing Sheets

ELECTRICAL CONNECTING DEVICE

TECHNICAL FIELD

The present invention relates to an electrical connecting device that is connected to a to-be-connected housing element, which supports to-be-connected terminals of four or more poles which are arranged in a parallel manner in rectilinear form.

BACKGROUND ART

An electrical connecting device that is connected to a to-be-connected housing element, which supports to-be-connected terminals of four or more poles which are arranged in a parallel manner in rectilinear form has been conventionally known. Japanese Published Unexamined Patent Application H11-251002, for example, discloses a coaxial connector having a number of cores which is formed of a plug connecting part and a receptacle connecting part as a connector that includes the above-described electrical connecting device. In this coaxial connector, the plug coupling part is provided with four poles of the first central contacts and the first external contacts, and these four pole contacts are arranged in a parallel manner in rectilinear form. Meanwhile, in the receptacle coupling part, four pole second central contacts and second external contacts which are respectively electrically connected to the four pole contacts on the plug coupling part side are arranged in a parallel manner in rectilinear form, at points which respectively correspond to the four pole contacts on the plug coupling part side. Thus, four coaxial cables which correspond to and are connected to the respective contacts lead out in a straight line on the side opposite the side where the four pole contacts on either side, the plug coupling part side or the receptacle coupling part side, are respectively connected in the arrangement.

In the coaxial connector that is described in Japanese Published Unexamined Patent Application H11-251002, however, the coaxial cable that leads out from either housing element on the plug coupling part side or the receptacle coupling part side is arranged so as to lead out in a straight line in the direction perpendicular to the direction in which each housing element is aligned in a parallel manner. Therefore, in either housing element, the size of the housing element may become too large, depending on the pitch between the poles which are arranged in a parallel manner.

Accordingly, there is some spatial restriction, due to the size of the housing elements when each connector is worked on so as to be connected. That is, it is extremely inconvenient to work on a connection within a limited space or through such a space, like work in a narrow space.

This is extremely inconvenient particularly in the case where a to-be-connected housing element that supports to-be-connected terminals of four or more poles which are arranged in a parallel manner in a rectilinear form, and an electrical apparatus having a to-be-connected housing element that supports connection terminals of four or more poles which are respectively electrically connected to each of the to-be-connected terminals are connected to each other after this electrical connecting device has been inserted into a hole that is provided in a wall. That is, the size of the electrical connecting device that is inserted into a hole provided in a wall restricts the size of this hole, or makes the work of insertion of the electrical connecting device difficult.

DISCLOSURE OF THE INVENTION

In view of the above-described situation, an object of the present invention is to provide a compact electrical connecting device that can reduce the inconvenience of the dimensional restriction in the case where a to-be-connected housing element that supports to-be-connected terminals of four or more poles which are arranged in a parallel manner in rectilinear form and an electrical connecting device having a connecting housing element that supports connection terminals of four or more poles which are respectively electrically connected to each of the to-be-connected terminals are connected to each other.

The present invention relates to an electrical connecting device that is connected to a to-be-connected housing element that supports to-be-connected terminals of four or more poles which are arranged in a parallel manner in rectilinear form.

Thus, the electrical connecting device according to the present invention is characterized by several points, as described above, in order to achieve the above-described object. That is, the present invention has any of the below described characteristics, either by themselves or in an appropriate combination.

In order to achieve the above-described object, an electrical connecting device according to the present invention is firstly characterized by comprising: connection terminals of four or more poles which are, respectively, electrically connected to the above-described to-be-connected terminals of four or more poles and which, respectively, have terminal connecting parts that are connected to the above-described to-be-connected terminals, wire connecting parts that are connected to wires at ends on the side opposite the terminal connecting parts and bent parts which are formed so as to be bent between the terminal connecting parts and the wire connecting parts; a connecting housing element which has terminal supporting parts for supporting the above-described connection terminals, respectively, in a manner where the above-described terminal connecting parts are aligned in rectilinear form so as to be connected to the above-described to-be-connected terminals, respectively, and which is engaged with and connected to the above-described to-be-connected housing element; and a cover element that is attached to the above-described connecting housing element so as to cover the above-described connection terminals, wherein wires that are connected to the above-described wire connecting parts are supported between the above-described connecting housing element and the above-described cover element so as to be arranged in the direction parallel to the direction in which the above-described terminal connecting parts are arranged in rectilinear form and the above-described cover element has a rounded lid portion that is formed in circular arc form in the cross section perpendicular to the direction in which the wires that are supported between the cover element and the above-described connecting housing element are arranged in a parallel manner.

In this configuration, the bent parts are formed between the terminal connecting parts and the wire connecting parts in the connection terminals and wires that are connected to the wire connecting parts are arranged in the direction parallel to the direction in which the terminal connecting parts are arranged in rectilinear form. In addition, the cover element is provided with a round lid portion that is formed in circular arc form in the cross section perpendicular to the direction in which wires are arranged in a parallel manner. Therefore, wires, each of which is parallel to the rest, can be arranged so as to be bundled and efficiently arranged inside the rounded lid portion in circular arc form and thus the space for arranging wires inside the round lid portion can be reduced. That is, an increase in the size of the electrical connecting device caused by the pitch of the terminal connecting parts that are arranged in a parallel manner can be greatly avoided and miniaturization of the electrical connecting device can be achieved. As a result, it becomes convenient when connection work is carried out within a limited space or through such a space like a work in a narrow space. In addition, the electrical connecting device has a form that extends for a great length in the direction in which the terminal connecting parts are arranged in rectilinear form and therefore, it becomes very convenient particularly in the case where connection is made after the electrical connecting device has been inserted into a hole provided in a wall. That is, the size of this hole can be reduced and the work of inserting the electrical connecting device can be easily carried out. In addition, a rounded lid portion is formed in the cover element so that a portion of the outer peripheral of the electrical connecting device follows the inner peripheral of a circular hole and interference between the electrical connecting device and the edge portion of the hole can be avoided and therefore, further miniaturization of the electrical connecting device can be achieved. Accordingly, a compact electrical connecting device can be provided where inconvenience caused by restriction in the dimensions can be reduced in the case where a to-be-connected housing element for supporting to-be-connected terminals of four or more poles which are aligned in rectilinear form and an electrical connecting device having a connecting housing element for supporting connection terminals of four or more poles which are, respectively, electrically connected to these to-be-connected terminals are connected to each other.

The electrical connecting device according to the present invention is secondly characterized in that the above-described bent parts are formed so as to be bent in a right angle.

In this configuration, the distance between the line along which the terminal connecting parts are arranged in a parallel manner and a wire that is connected to a wire connecting part and arranged parallel to this line can be reduced. That is, the form that extends in the direction in which the terminal connecting parts are arranged can be narrowed, and thereby, the electrical connecting device can be miniaturized.

The electrical connecting device according to the present invention is thirdly characterized in that wire supporting parts for supporting respective wires that are connected to the above-described wire connecting parts in a manner where the respective wires are arranged in the direction parallel to the direction in which the above-described terminal connecting parts are arranged in rectilinear form are formed in the above-described connecting housing element.

In this configuration, wire supporting parts are formed in the connecting housing element and thereby, wires can be stably supported between the connecting element and the cover element in the direction parallel to the direction in which the terminal connecting parts are arranged in rectilinear form.

The electrical connecting device according to the present invention is fourthly characterized in that a restricting part for restricting movement of the above-described connection terminals toward the above-described cover element side between the cover element and the connecting housing element at the time when the above-described cover element is attached to the above-described connecting housing element is formed in the above-described cover element.

In this configuration, the restricting part is provided and thereby, the positions of the to-be-connected terminals can be fixed in the direction toward the cover element side at the same time as the cover element is attached and the connection terminals can be prevented from being supported in an inappropriate state.

The electrical connecting device according to the present invention is fifthly characterized in that the above-described restricting part is formed so as to protrude toward the above-described connecting housing element to which the above-described cover element is attached and make contact with the above-described connection terminals so as to restrict movement of the connection terminals.

In this configuration, restricting part for restricting movement of the connection terminals in the state of the cover element being attached can be implemented in a simple structure.

The electrical connecting device according to the present invention is sixthly characterized in that the above-described cover element is formed in a manner where an end on the front end side that is opposite the side from which wires that are connected to the above-described wire connecting parts lead out from the cover element is tapered toward the front end side.

In this configuration, the end on the front end side is formed so as to be tapered toward the front end side and thereby, insertion of the electrical connecting device into a hole can be smoothly and easily carried out in the case where the electrical connecting device is inserted into the hole so as to be connected to the to-be-connected housing element.

The electrical connecting device according to the present invention is seventhly characterized in that an end on the front end side of the above-described cover element is formed in a manner where the cross section perpendicular to the direction toward the front end side is in either form, point symmetric form or linear symmetric form.

In this configuration, the end on the front end side is formed so as to have a cross section in either form, point symmetric form or linear symmetric form and thereby, it becomes easy to secure strength against an impact that works in the direction of bending the tapered end, Thus, occurrence of damage to the end on the front end side can be prevented even in the case where the end collides with the edge portion of a hole so as to receive an impact at the time of insertion of the electrical connecting device into the hole when the electrical connecting device is inserted into the hole so as to be connected to the to-be-connected housing element.

The electrical connecting device according to the present invention is eighthly characterized in that the end on the above-described front end side of the above-described cover element is formed in a manner where the cross section perpendicular to the direction toward the front end side is in a cross form.

In this configuration, the end on the front end side is formed in a manner where the cross section is in a cross form, and thereby, it is easy to secure strength against an impact that works in the direction of bending the tapered end. Thus, occurrence of damage to the end on the front end side can be prevented even in the case where the end collides with the edge portion of a hole so as to receive an impact at the time of insertion of the electrical connecting device into the hole when the electrical connecting device is inserted into the hole so as to be connected to the to-be-connected housing element. In addition, the cross section is in a cross form, and thereby, the cross section can be easily made to be in point symmetric form or linear symmetric form.

The electrical connecting device according to the present invention is ninthly characterized in that the form of the end on the side from which wires that are connected to the above-described wire connecting parts lead out from the cover element and the form of the end on the front end side that is opposite the side from which the wires lead out from the cover element are different from each other in the above-described cover element.

In this configuration, the direction in which the cover element is attached to the connecting housing element can be limited to one direction. As a result, incorrect connections at the time of assembly of the electrical connecting device can be prevented.

The electrical connecting device according to the present invention is tenthly characterized in that a reinforcing portion is additionally formed so as to be partially thick in the above-described rounded lid portion of the above-described cover element.

In this configuration, a region inside the rounded lid portion can be effectively used so that a partially thick reinforcing portion can be provided in the rounded lid portion in a place where the reinforcing portion does not interfere with wires and connection terminals which are placed inside the rounded lid portion. Therefore, strength in the rounded lid portion can be increased while the miniaturization of the cover element is slightly hindered.

The electrical connecting device according to the present invention is eleventhly characterized in that the above-described reinforcing portion is provided with a first reinforcing portion which is formed as a rib that protrudes toward the above-described connecting housing element to which the above-described cover element is attached and which is formed in rectilinear form.

In this configuration, a rib in rectilinear form is formed inside the rounded lid portion, and thereby, the reinforcing portion for increasing strength in the rounded lid portion can be implemented in a simple structure.

The electrical connecting device according to the present invention is twelfthly characterized in that the above-described first reinforcing portion is formed in rectilinear form in the direction parallel to the direction in which the above-described terminal connecting parts in the above-described connecting housing element to which the above-described cover element is attached are arranged in rectilinear form.

In this configuration, the rib that forms the first reinforcing portion is formed in rectilinear form in the direction parallel to the direction in which the terminal connecting parts are arranged in linear form, that is, in the longitudinal direction of the cover element, and therefore, strength can be increased against bending of the cover element in the longitudinal direction.

The electrical connecting device according to the present invention is thirteenthly characterized in that the above-described reinforcing portion is formed as a rib that protrudes toward the above-described connecting housing element to which the above-described cover element is attached and is further provided with a second reinforcing portion that is formed so as to be arranged along the cross section of the above-described rounded lid portion perpendicular to the direction in which the above-described terminal connecting parts are arranged in rectilinear form in the connecting housing element.

In this configuration, the rib that forms the second reinforcing portion is formed so as to be arranged along the cross section perpendicular to the direction in which the terminal connecting parts are arranged in rectilinear form, that is, along the cross section of the rounded lid portion perpendicular to the longitudinal direction of the cover element, and therefore, strength can be increased against twisting of the cover element in the longitudinal direction.

The electrical connecting device according to the present invention is fourteenthly characterized in that a reinforcing portion is further formed so as to be partially thick in the above-described rounded lid portion of the above-described cover element and restricting portions which are the same as the above-described restricting portion are formed in a number of places and the above-described number of restricting portions are integrally formed via the above-described reinforcing portion in the above-described cover element.

In this configuration, strength of the rounded lid portion can be increased by providing this reinforcing portion while miniaturization of the cover element is slightly hindered and furthermore, a number of restricting portions can be effectively utilized as portions of this reinforcing portion.

The electrical connecting device according to the present invention is fifteenthly characterized in that the electrical connecting device is used to be connected to the above-described to-be-connected housing element after being inserted into a hole that is provided for insertion of wires between the inside and outside of an automobile.

In this configuration, the electrical connecting device can be easily inserted into a hole that is provided for the insertion of wires between the inside and outside of an automobile, and in addition, the size of this hole can be reduced.

Here, the above-described and other objects, features and advantages of this invention will be clarified by reading the following description together with the attached drawings.

BEST MODE FOR CARRYING OUT THE INVENTION

In the following, the best mode for carrying out the present invention is described with reference to the drawings. Here, although, according to the present mode, an electrical connecting device that is connected to a to-be-connected housing element which supports to-be-connected terminals of four poles (four pieces) is described, the present invention is applicable in the case where there are five poles or more. That is, the present invention can be widely applied to an electrical connecting device that is connected to a to-be-connected housing element which supports to-be-connected terminals of four or more poles which are aligned in a line.

In addition, the present invention is particularly suitable for use in a case where an electrical connecting device is connected to a to-be-connected housing element after being inserted into a hole that is provided for the insertion of wires between the inside and outside of an automobile, and the present mode is described by citing this application as an example. However, the present invention is applicable even in the case where an electrical connecting device is used differently from this application, and can be applied for broader use. That is, the present invention can be applied in a variety of environments and for a variety of purposes.

(First Embodiment)

Figure 1:
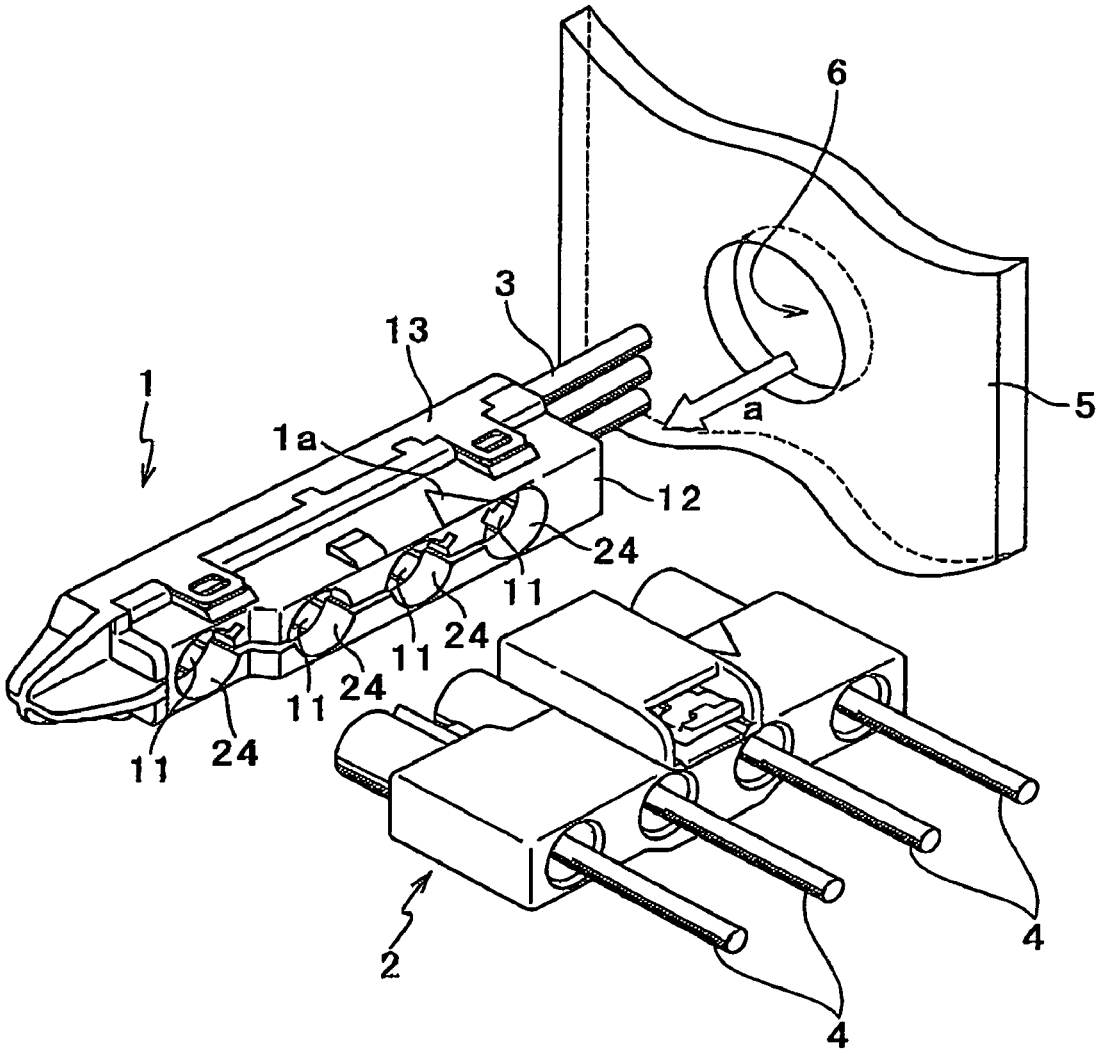
FIG. 1 is a perspective view illustrating an electrical connecting device according to one embodiment of the present invention and a to-be-connected housing element that is connected to this electrical connecting device.

FIG. 1 is a perspective view illustrating a to-be-connected housing element 2 to which coaxial wires 4 of four poles (four wires) (hereinafter referred to as wires 4) are connected as well as an electrical connecting device 1 according to the first embodiment of the present invention, which is connected to coaxial wires 3 of four poles (four wires) (hereinafter referred to as wires 3), and is connected to to-be-connected housing 2 (here only three wires 3 are illustrated in this perspective view). Electrical connecting device 1 and to-be-connected housing element 2 are used as relay connectors which are utilized in a variety of complex antennas that are attached to automobiles, such as, for example, an AM/FM antenna, a cellular antenna, a GPS (Global Positioning System) antenna, an SDARS (Satellite Digital Audio Radio System) antenna, an ETC antenna and a VICS antenna.

Figure 2:
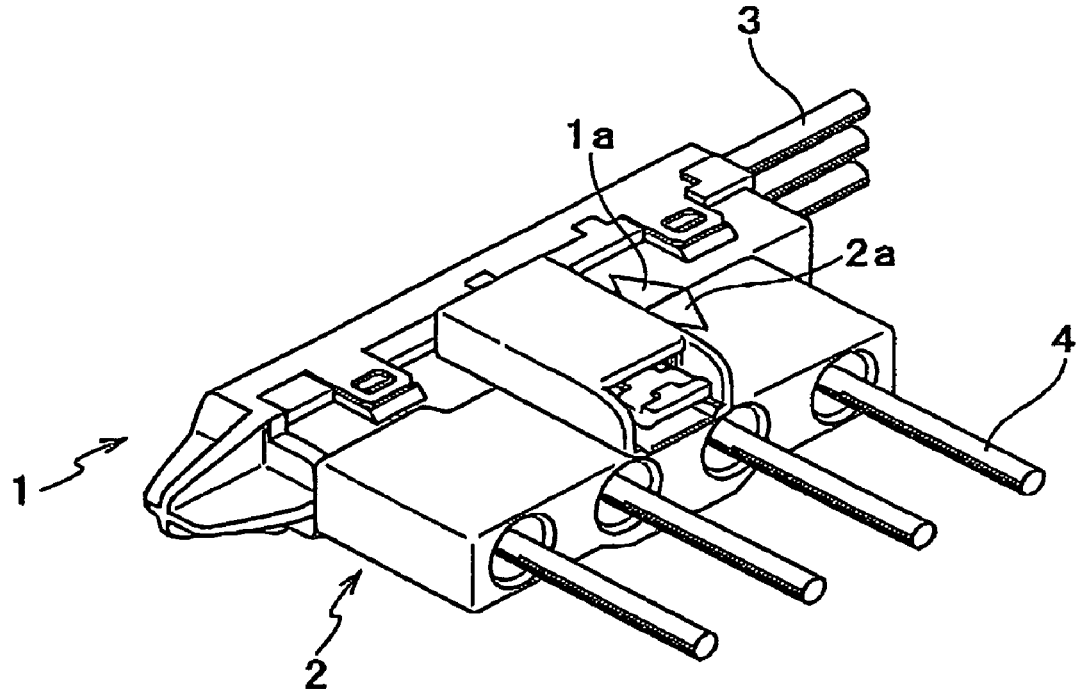
FIG. 2 is a perspective view showing the state where the electrical connecting device and the to-be-connected housing element shown in FIG. 1 are connected to each other.

Thus, electrical connecting device 1 is connected to to-be-connected housing element 2 after being inserted in the direction of arrow a into a roof hole 6, which is provided in a roof 5 of an automobile of which a portion is illustrated in FIG. 1. As a result, a state is gained where wires 3 and wires 4 pass through roof hole 6 between the inside and outside of the automobile and are electrically connected to each other via connectors (1 and 2). Thus, as shown in the perspective view of FIG. 2, electrical connecting device 1 and to-be-connected housing element 2 are connected to each other. Here, a mark 1*a* (triangular mark) is attached to electrical connecting device 1 and a mark 2*a* (triangular mark) is attached to to-be-connected housing element 2. These marks (1*a* and 2*a*) are attached in a manner where the position thereof match when electrical connecting device 1 and to-be-connected housing element 2 are appropriately connected to each other and whether or not they are appropriately connected can be confirmed from whether or not both marks (1*a* and 2*a*) are in the state where their positions match.

Figure 3:
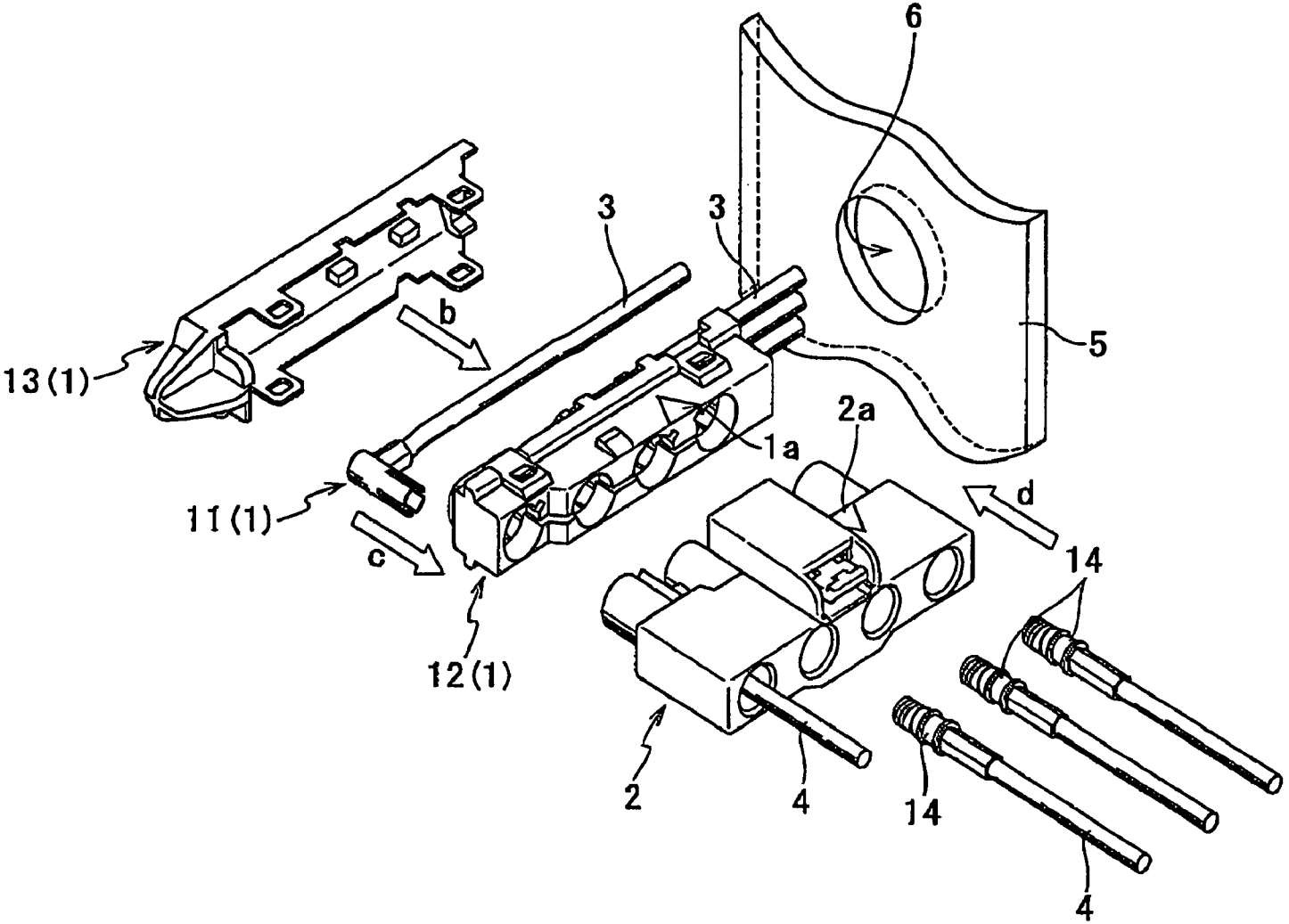
FIG. 3 is an exploded perspective view showing the electrical connecting device and the to-be-connected housing element shown in FIG. 1.

FIG. 3 is an exploded perspective view showing electrical connecting device 1 and to-be-connected housing element 2. Electrical connecting device 1 is provided with connection terminals 11 of four poles (four pieces) which are respectively connected to the ends of four wires 3, a connecting housing element 12 which is engaged and connected to to-be-connected housing element 2, and a cover element 13 which is attached to to-be-connected housing element 12. Connection terminals 11 in the state of being connected to wires 3 are engaged in the direction of arrow c in the figure and respectively supported by connecting housing element 12. In addition, cover element 13 is engaged in the direction of arrow b in the figure and attached to connecting housing element 12 so as to cover connection terminals 11. Here, to-be-connected terminals 14 which are respectively connected to wires 4 are engaged in the direction of arrow d in the figure and respectively supported by to-be-connected housing element 2.

Figure 4:
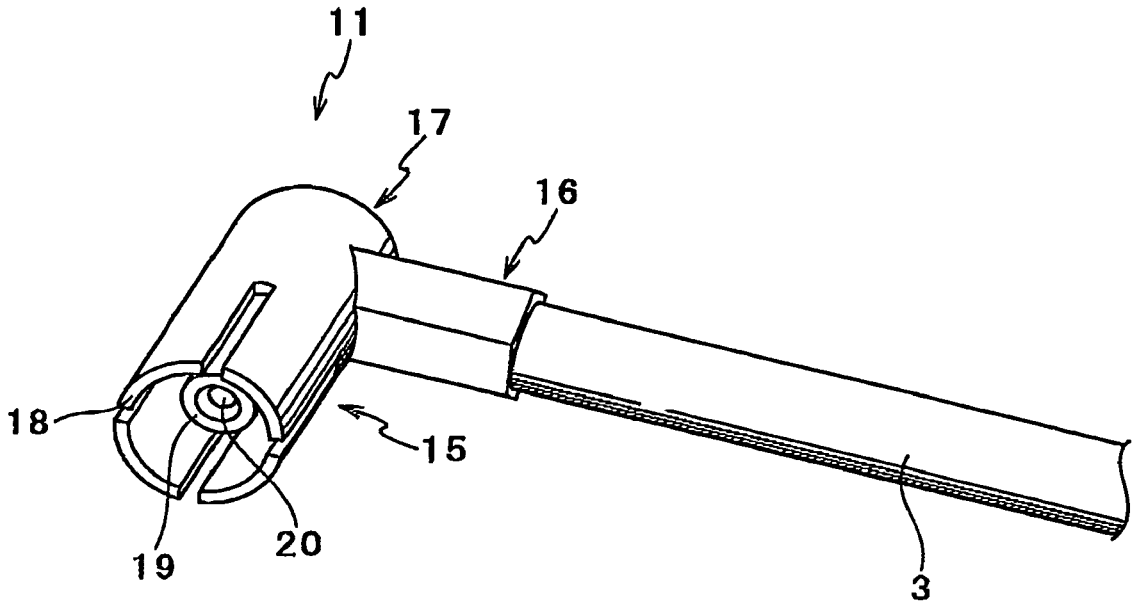
FIG. 4 is a perspective view showing a connection terminal shown in FIG. 3.

Connection terminals 11 are respectively electrically connected to to-be-connected terminals 14 at the same time as the connection between electrical connecting device 1 and to-be-connected housing element 2. Such a connection terminal 11, as shown in the perspective view of FIG. 4, is provided with a terminal connecting part 15, a wire connecting part 16 and a bent part 17. Terminal connecting part 15 has an outer shell 18, an isolator 19, a center terminal 20 and the like, and is formed for a coaxial wire. In addition, this terminal connecting part 15 makes contact with and is connected to a connected terminal 14. In addition, wire connecting part 16 is caulked and connected to a wire 3 at the end on the side opposite terminal connecting part 15. In addition, bent part 17 is a part between terminal connecting part 15 and wire connecting part 16, and is formed so as to be bent in a right angle.

Figure 5:
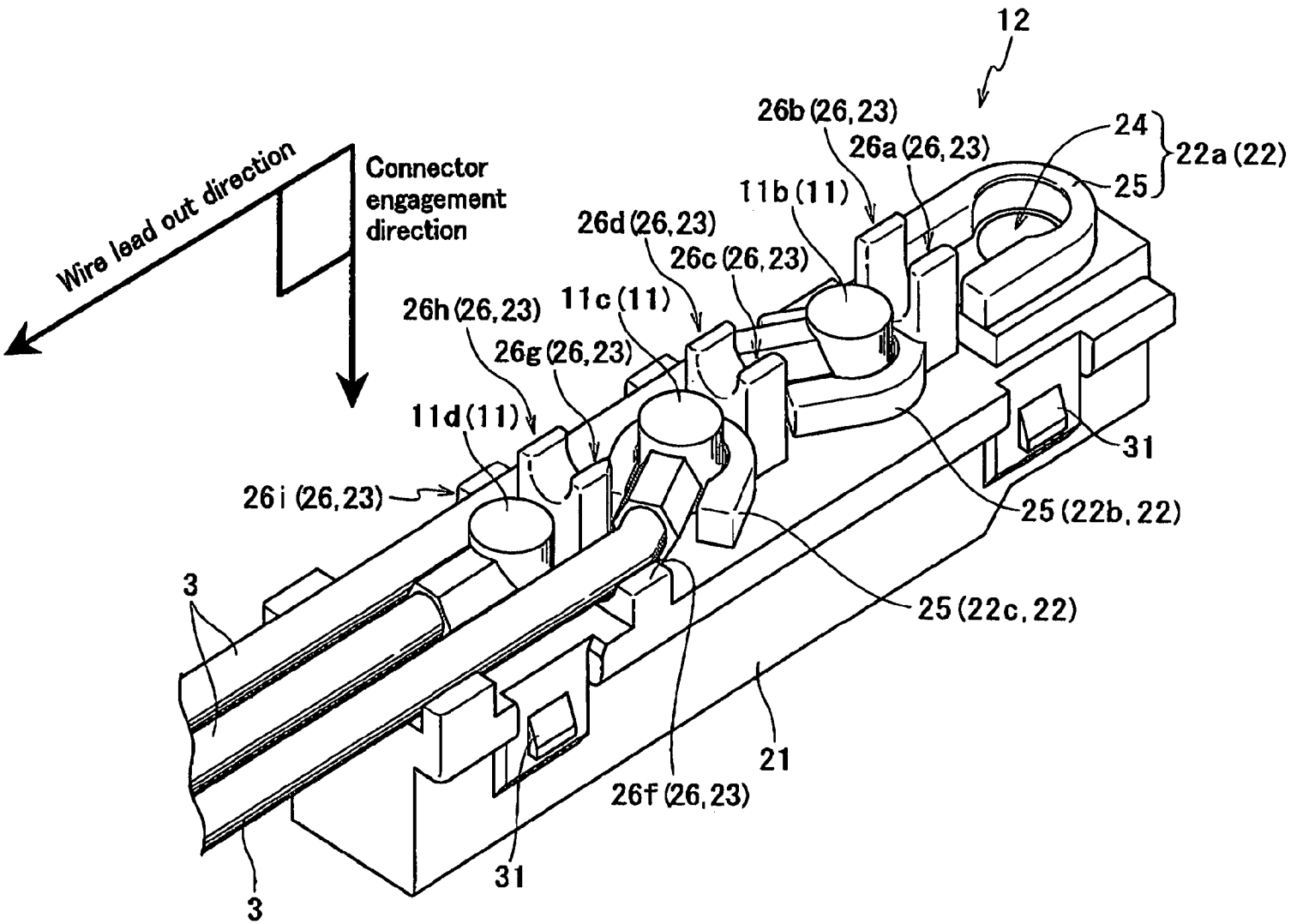
FIG. 5 is a perspective view showing the connecting housing element shown in FIG. 3.

FIG. 5 is a perspective view showing connecting housing element 12, and shows the state where connection terminals 11 (11*b* to 11*d*) of three poles which have been connected to wires 3 are attached to connecting housing element 12 (the state where only connection terminal 11*a* shown in FIG. 6 is not attached). Connecting housing element 12 has a body portion 21 that is formed in long parallelepiped form, and terminal supporting parts 22 and wire supporting parts 23 are formed on this body portion 21.

Terminal supporting parts 22 are provided in four places so as to respectively support connection terminals 11 of four poles, and FIG. 5 shows the manner in which connection terminal 11*b* is supported by terminal supporting part 22*b* and connection terminal 11*c* is supported by terminal supporting part 22*c*. These terminal supporting parts 22 are provided to support respective connection terminals 11 so that respective terminal connecting parts 15 of respective connection terminals 11 are aligned in rectilinear form. As a result of this, respective connection terminals 11 are connected to respective to-be-connected terminals 14 on the to-be-connected housing element 2 side. In addition, each terminal supporting part 22 has an engagement hole 24 and a positioning part 25 as a terminal supporting part 22*a* shown in FIG. 5. Engagement hole 24 is created so as to penetrate the body portion, and terminal connecting part 15 of a connection terminal 11 is engaged in this engagement hole 24. In addition, positioning part 25 is provided in a wall form which partially surrounds terminal connecting part 15 and wire supporting part 16 in the state where terminal connecting part 15 has been engaged in engagement hole 24, and allows the direction of connection terminal 11 that is supported by wire supporting part 22 to be fixed (to be positioned). Here, as shown in FIG. 1, engagement hole 24 opens on the bottom side of connecting housing element 12 (on the side that is engaged with to-be-connected housing element 2), and terminal connecting part 15 of each connection terminal 11 is supported in the state where it is exposed within this engagement hole 24. In addition, connection terminals 11 are in the state where they are aligned in a line, in a manner where each connection terminal 11 is connected to each connected terminal 14.

Figure 6A:
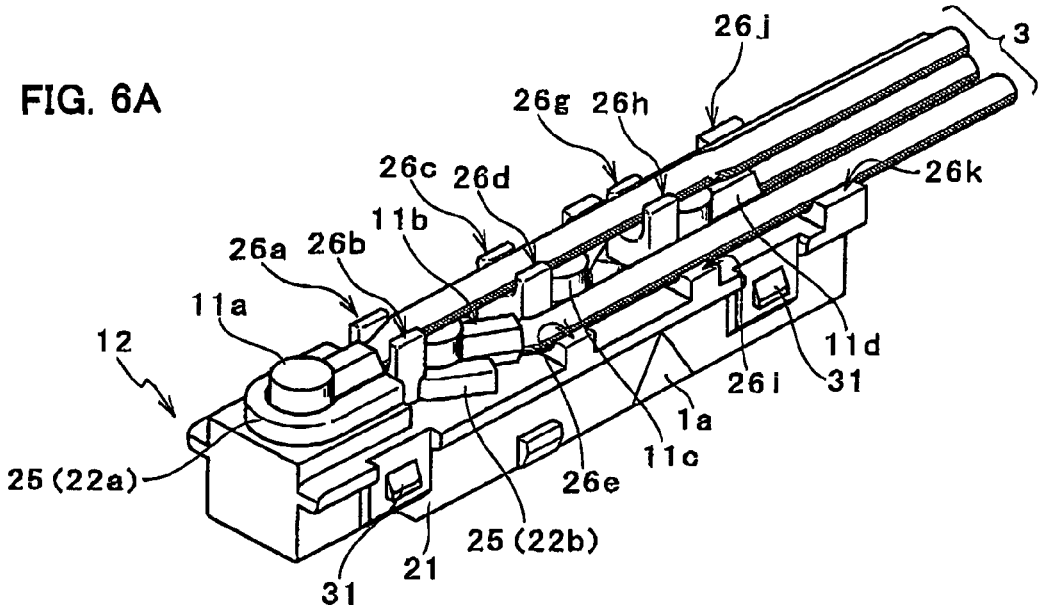
FIG. 6A is a perspective view showing the connecting housing element as viewed from the side opposite that of FIG. 5.
Figure 6B:
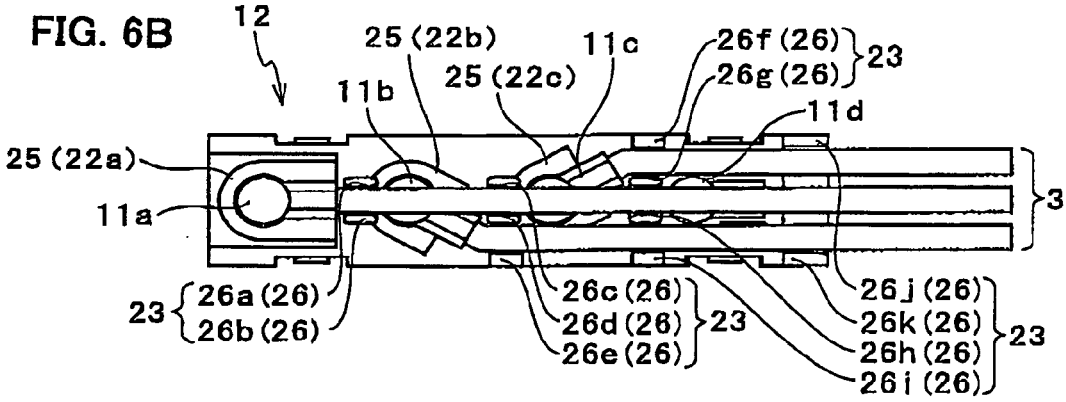
FIG. 6B is a plan view showing the connecting housing element shown in FIG. 6A.
Figure 6C:
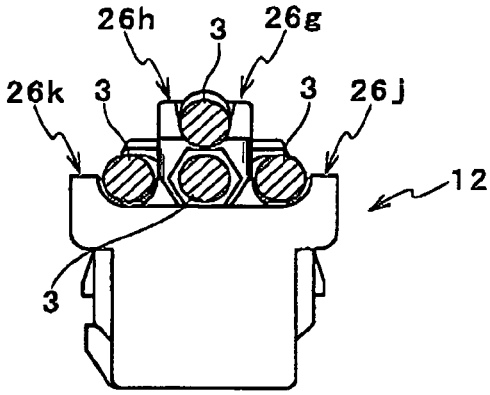
FIG. 6C is a side view as viewed from the right side of FIG. 6B.

FIG. 6 are a perspective view showing connecting housing element 12 as viewed from the side opposite that of FIG. 5 (FIG. 6A), a plan view thereof (FIG. 6B) and a side view as viewed from the right side of FIG. 6B (FIG. 6C). Here, FIG. 6 show the state where all connection terminals 11 of four poles to which wires 3 have been connected are attached to connecting housing element 12.

As shown in FIG. 5 and FIG. 6, wire supporting parts 23 support respective wires 3 so that wires 3 which are connected to wire connecting parts 16 of connection terminals 11 are placed in the direction parallel to the direction in which terminal connecting parts 15 are arranged in rectilinear form. These wire supporting parts 23 are formed as a number of protrusions 26 (26*a* to 26*k*) which are provided so as to protrude from connecting housing element 12. In addition, a wire 3 is engaged between a pair of protrusions 26 and 26, from among the number of protrusions 26, which are positioned so as to face each other, and thereby, wire 3 is stably supported. That is, wire 3 which is connected to connection terminal 11*a* is engaged between the respective pairs of protrusions 26 and 26 which are positioned so as to face each other (between 26*a* and 26*b*, between 26*c* and 26*d*, and between 26*g* and 26*h*), and thereby, is supported. In the same manner, wire 3 that is connected to connection terminal 11*b* is engaged between the respective pairs of protrusions 26 and 26 which are placed so as to face each other (between 26*d* and 26*e*, and between 26*h* and 26*i*), and thereby, is supported, and wire 3 that is connected to connection terminal 11*c* is engaged between the pair of protrusions 26 and 26 which are positioned so as to face each other (between 26*f* and 26*g*), and thereby, is supported. Thus, the respective protrusions 26 are provided so that the respective positions of the wires 3 can be supported by wire supporting parts 23 in the direction parallel to the direction in which terminal connecting parts 15 are arranged in rectilinear form.

As described above, the positions of respective wires 3 can be fixed in connecting housing element 12 so that respective wires 3 can lead out in the direction parallel to the direction in which terminal connecting parts 15 are arranged in rectilinear form, that is, in the direction perpendicular to the direction in which the connector is engaged (see FIG. 5). Thus, the positions of wires 3 are fixed, and thereby, dispersion of electrical wave interference properties among wires 3 (dispersion of electrical wave interference properties among units of electrical connecting device 1 as products) can be reduced. Here, in the case where connection terminals 11 and wires 3 are attached to connecting housing element 12 in an inappropriate manner, that is, in the case where wires 3 are not arranged along wire supporting parts 23, the structure does not allow the below described cover element 13 to be appropriately attached to connecting housing element 12, due to interference by protrusions 26 and wires 3. Therefore, in the case where electrical connecting device 1 is assembled in an incorrect manner, whether or not assembly has been appropriately carried out can be confirmed from whether or not cover element 13 can be appropriately attached to connecting housing element 12.

Figure 7:
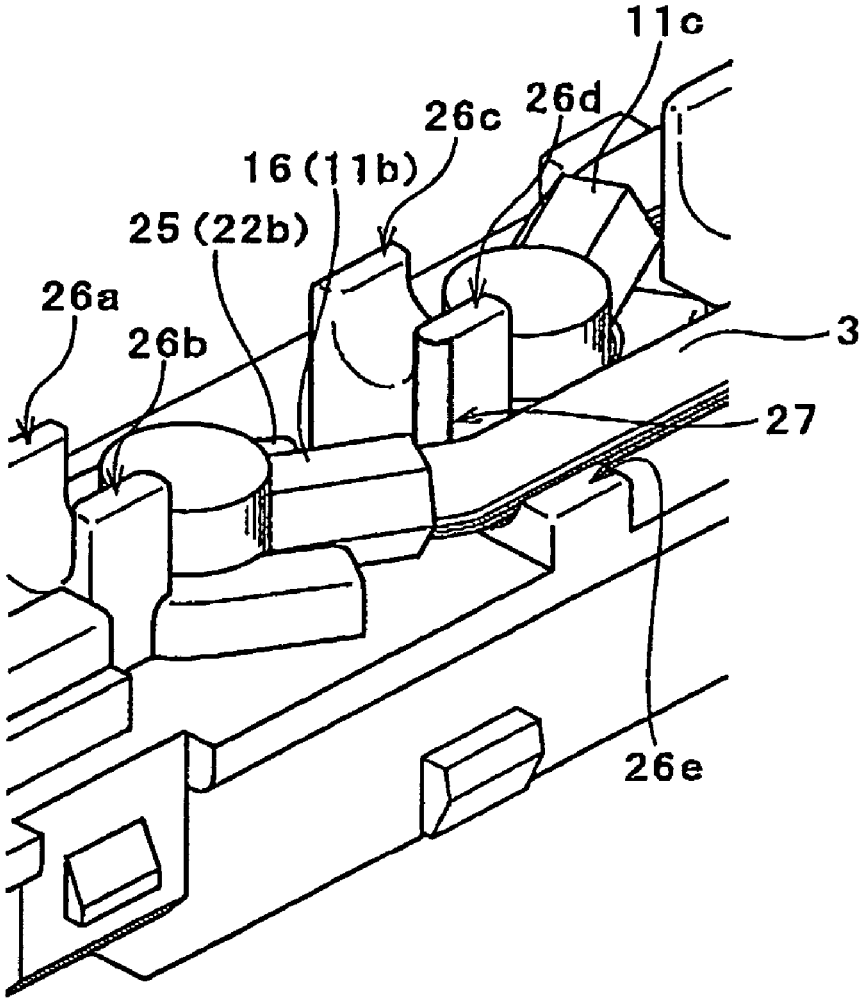
FIG. 7 is an enlarged perspective view showing a portion of the connecting housing element as viewed in the same direction as that of FIG. 6A.

Here, FIG. 7 is a perspective view showing an enlarged portion of connecting housing element 12 as viewed from the same direction as in FIG. 6A, and shows the state where wire 3 that is connected to connection terminal 11*a* is not attached. As shown in FIG. 7, the portion of protrusion 26*c* which makes contact with wire 3 that is connected to wire connecting part 16 of connection terminal 11*b* on the side surrounding the protrusion (wire contacting portion 27 surrounded and indicated by a frame line) is formed so as to have a smoothly curved surface. Wire contacting portion 27 is formed so as to have a smoothly curved surface in this manner (R portion is formed), and thereby, wire 3 can be prevented from being damaged by this contacting portion. In particular, the performance of a coaxial wire for high frequency is easily deteriorated (VSWR) when bent, and the occurrence of such deterioration in performance can be prevented.

In addition, as shown in FIG. 6, wire supporting parts 23 support respective wires 3 in a manner where cross sections of the portions of respective wires 3 that are connected to wire connecting parts 16, which are supported by these wire supporting parts 23, are stacked in step form, where the upper step is located toward the side opposite the side on which terminal connecting parts 15 are arranged in connecting housing element 12. Thus, as shown in FIG. 6C, wire supporting part 23 in this portion supports respective wires 3 in a manner where the cross sections of the portions of respective wires 3 which are supported by this wire supporting part 23 are arranged in chevron form and positioned in grid form.

In addition, FIG. B is a front view of connecting housing element 12 in the state where all connection terminals 11 to which wires 3 have been connected are attached. As shown in this FIG. 8, connection terminal 11*a* that is connected to wire 3*a* which is placed on the upper step side in the stacked arrangement in step form is supported by terminal supporting part 22*a* so as to be positioned on the upper step side relative to connection terminals 11*b*, 11*c* and 11*d* that are connected to wires 3*b* or the like, which are placed on the lower step side of the arrangement. That is, a step is provided so that a height difference Δh is caused between the upper surface (flat surface on the upper step side) of connection terminal 11*a* that is placed on the upper step side and the upper surface of connection terminals 11*b*, 11*c* and 11*d*, that are placed on the lower step side.

Figure 9A:
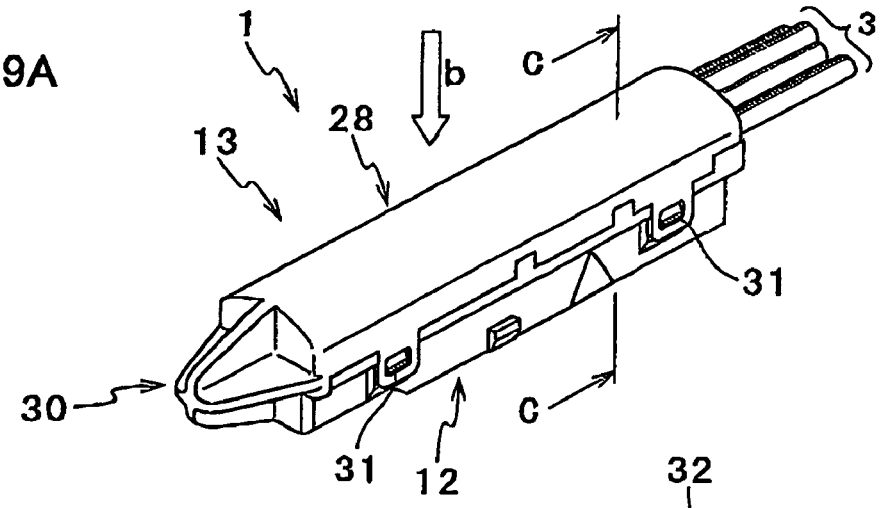
FIG. 9A is a perspective view of the electrical connecting device shown in FIG. 1.
Figure 9B:
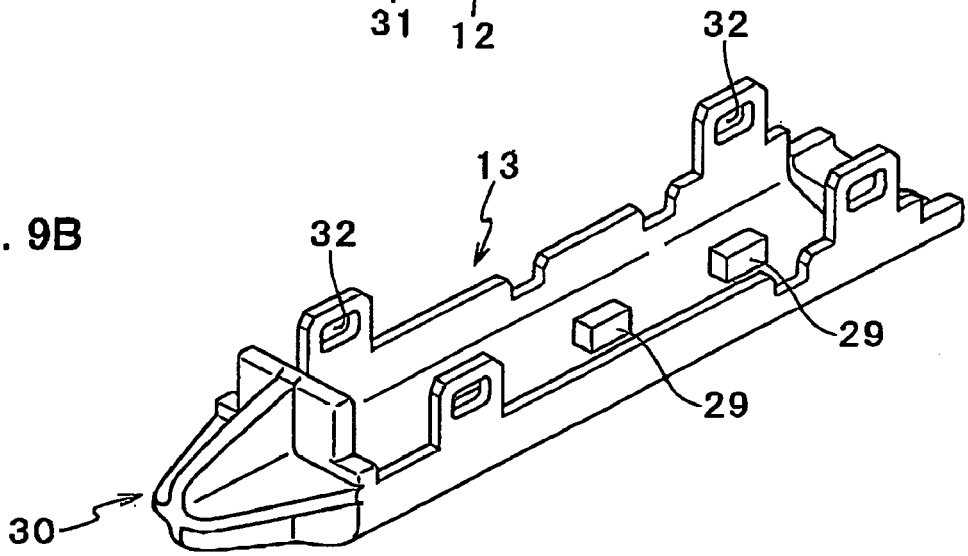
FIG. 9B is a perspective view showing the cover element shown in FIG. 9A.
Figure 9C:
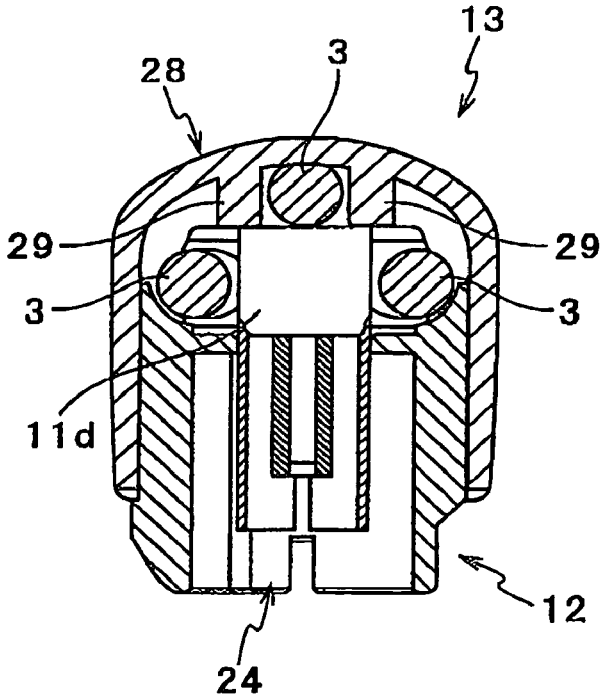
FIG. 9C is a cross sectional view along line C—C of FIG. 9A.

FIG. 9 are a perspective view showing electrical connecting device 1 (FIG. 9A), a perspective view showing cover element 13 of which the side that is attached to connecting housing element 12 faces upward (FIG. 9B), and a cross sectional view along line C—C of FIG. 9A (FIG. 9C). Here, FIG. 9C shows a cross section of connection terminal 11*d* of which a portion has been cut out. As shown in FIG. 9A, cover element 13 is engaged with housing element 12 in the direction of arrow b in the figure (see FIG. 3), and is attached so as to cover connection terminals 11. Here, engagement recesses 32 (see FIG. 9B) for engagement with engagement protrusions 31 (see FIG. 6A and FIG. 9A) that have been provided on the surface surrounding connecting housing element 12 are created in cover element 13. Thus, when cover element 13 is attached to connecting housing element 12, engagement protrusions 31 and engagement recesses 32 become engaged, and thereby, cover element 13 can be held by connecting housing element 12 without fail. In addition, as shown in FIG. 9A and FIG. 9C, this cover element 13 is provided with a curved lid portion 28 that has been formed in a circular arc form in the cross section perpendicular to the direction in which wires 3 are arranged in a parallel manner by means of wire supporting parts 23 of connecting housing element 12. As described above, respective wires 3 are arranged in chevron form and stacked in step form on connecting housing element 12, and such arrangement in step form allows wires 3 of four poles to be densely arranged inside round lid portion 28.

In addition, as shown in FIG. 9B and FIG. 9C, cover element 13 is provided with restricting parts 29 which restrict movement of connection terminals 11 toward the cover element 13 side in the space between this cover element 13 and connecting housing element 12 when cover element 13 is attached to connecting housing element 12. These restricting parts 29 are formed so as to protrude from a number of places toward the connecting housing element 12 side to which cover element 13 is attached. Thus, these restricting parts 29 make contact with connection terminals 11 when cover element 13 is attached to connecting housing element 12, and thereby, movement of theses connection terminals 11 is restricted. Restricting parts 29 are provided as described above, and thereby, the positions of connection terminals 11 can be secured in the direction in which the connector is engaged (see FIG. 5) at the same time as cover element 13 is attached, and thus, connection terminals 11 can be prevented from being supported in an inappropriate state (being inserted halfway).

In addition, cover element 13 is formed as shown in FIG. 9A and FIG. 9B in a manner where end 30 on the front end side that is opposite the side from which wires 3 lead out from this cover element 13 is tapered toward this front end side. As described above, end 30 is formed so as to be tapered toward the front end side, and thereby, insertion into roof hole 6 can be smoothly and easily carried out. In addition, end 30 is formed in point symmetric form and at the same time, linear symmetric form in the cross section perpendicular to the direction toward the front end side. Here, concretely speaking, the form of end 30 in the cross section is in a cross form. As described above, end 30 is formed in either point symmetric form or linear symmetric form in the cross section, and thereby, strength is secured against an impact that works in the direction of bending of tapered end 30 and occurrence of damage in end 30 can be prevented even when end 30 collides with the edge portion of roof hole 6 so as to receive an impact at the time of insertion into roof hole 6. In addition, point symmetric form and linear symmetric form in the cross section can be easily formed by providing a cross form in the cross section.

In addition, the form of the end on the side from which wires 3 lead out and the form of end 30 on the side opposite this side from which wires lead out are different from each other in cover element 13. Therefore, the direction of attachment of cover element 13 to connecting housing element 12 can be limited to one direction. As a result of this, incorrect connections can be prevented at the time of assembly of electrical connecting device 1.

In the above-described electrical connecting device 1, bent parts 17 are formed between terminal connecting parts 15 and wire connecting parts 16 in connection terminals 11 and wires 3 that are connected to wire connecting parts 16 placed in the direction parallel to the direction in which terminal connecting parts 15 are arranged in rectilinear form. In addition, cover element 13 is provided with a rounded lid portion 28 that is formed to be in circular arc form in the cross section perpendicular to the direction in which wires 3 are arranged in a parallel manner. Therefore wires 3, each of which is parallel to the rest, can be arranged so as to be bundled and efficiently arranged inside rounded lid portion 28 in circular arc form and the space for arranging wires 3 can be densely provided on the inner side of rounded lid part 28. That is, an increase in the size of the electrical connecting device caused by the pitch of the terminal connecting parts 15 which are aligned can be greatly avoided and miniaturization of the electrical connecting device can be achieved.

As a result, it is convenient when a connection work is carried out within a limited space or through such a space like a work in a narrow space. In addition, electrical connecting device 1 has a form that extends for a great length in the direction where terminal connecting parts are arranged in rectilinear form and therefore, it becomes very convenient particularly in the case where connection is made after electrical connecting device 1 has been inserted into a hole provided in a wall. That is, the size of this hole can be reduced and a work of inserting electrical connecting device 1 can be easily carried out.

Figure 10:
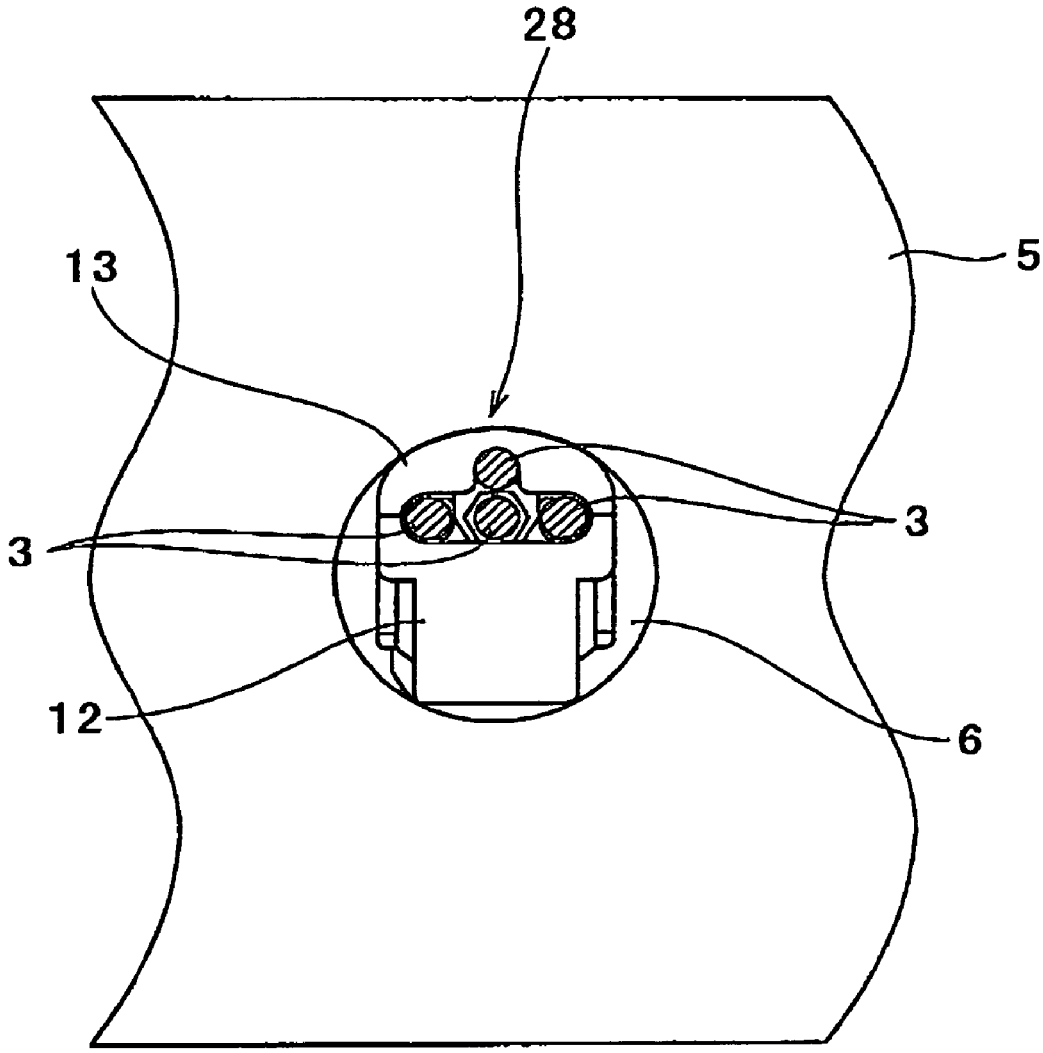
FIG. 10 is a diagram showing the state where the assembled electrical connecting device has been inserted into a hole in the roof of an automobile.

FIG. 10 is a diagram showing assembled electrical connecting device 1 in the state where electrical connecting device 1 has been inserted into roof hole 6 as viewed from the side from which wires 3 lead out. Electrical connecting device 1 can be miniaturized by being made narrow, and the area of the cross section in the direction of insertion into roof hole 6 can be reduced and therefore, electrical connecting device 1 can be made to smoothly pass through roof hole 6 having a small opening area as shown in FIG. 10. In addition, rounded lid portion 28 is formed in cover element 13 and therefore, a portion of the outer periphery of electrical connecting device 1 can follow in the inner periphery of circular roof hole 6 so that interference with the edge portion of roof hole 6 can be avoided, and thereby, miniaturization of the electrical connecting device can be achieved.

Accordingly, in electrical connecting device 1, inconvenience caused by restrictions in the dimensions can be reduced in the case where the to-be-connected housing element for supporting the to-be-connected terminals of four or more poles which are aligned in rectilinear form and the electrical connecting device having the connecting housing element for supporting the connection terminals of four or more poles which are, respectively, electrically connected to the to-be-connected terminals are connected to each other, and thereby, miniaturization of the electrical connecting device can be achieved.

In addition, in electrical connecting device 1, wires 3 which are connected to wire connecting parts 16 and arranged in a parallel manner are arranged in a manner where the cross sections thereof are stacked in step form, and therefore, wires 3, each of which is parallel to the rest, can be densely arranged so as to be bundled, and the space for arranging wires 3 can be reduced. That is, electrical connecting device 1 can be prevented from spreading in the direction of the width relative to the direction in which terminal connecting parts 16 are arranged, and thus, miniaturization can be achieved.

Figure 8:
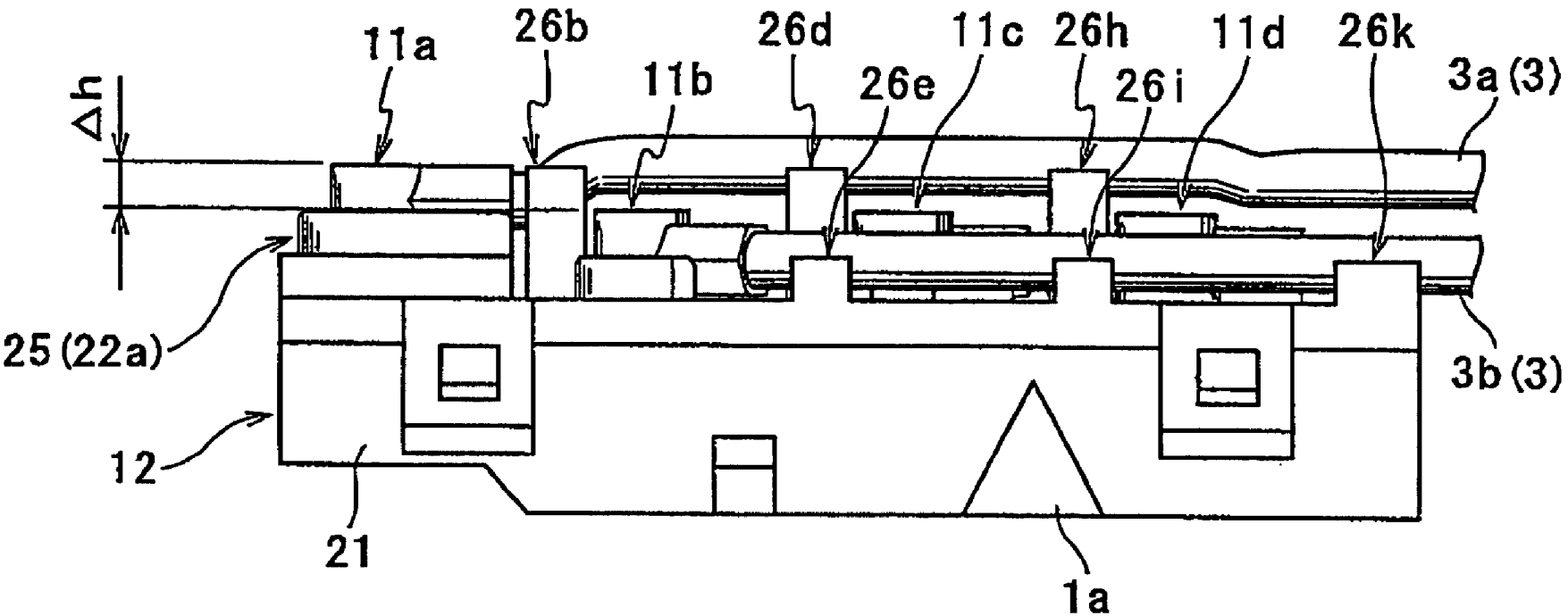
FIG. 8 is a front view showing the connecting housing element shown in FIG. 6A.

In addition, in electrical connecting device 1, connection terminal 11*a* that is connected to wire 3*a* which is arranged on the upper step side is supported and located in the step together with the lower step side (with a height difference of Δh) (see FIG. 8). Therefore, the curvature that occurs as a result of bending of the portion of wire 3*a* on the upper step side between the part which passes above wire 3*b* or the like on the lower side and the part connected to a wire connecting part 16 can be reduced, and the occurrence of damage in wire 3*a* arranged on the upper step side can be prevented.

In addition, in electrical connecting device 1, wires 3 which are connected to wire connecting parts 16 and arranged in a parallel manner can be arranged in a manner where the cross sections thereof are stacked in step form and can be supported so as to be arranged in chevron form and positioned in grid form. Therefore, wire 3*a* on the upper step side can be supported as it is simply by extending a wire supporting part 23 on the lower step side upward, and thus, the structure of wire supporting parts 23 can be simplified in the case where wires 3 are stacked in step form. In addition, terminal connecting parts 15 on the upper step side can be prevented from spreading in the direction of the width relative to the direction in which terminal connecting parts 15 are arranged, and miniaturization of the electrical connecting device can be achieved.

In addition, in electrical connecting device 1, a wire 3 can be engaged between a pair of protrusions 26 and 26 which face each other from among a number of protrusions 26 that have been provided in connecting housing element 12, and thereby, wire 3 can be supported, making the formation of wire supporting parts 23 easy.

Although the first embodiment of the present invention is described above, modifications and applications will naturally be clarified by reading and understanding the present specification, and such modifications and applications which are included in the claims as well as equivalent meanings to the claims, are all intended to be included in the scope of the present invention.

The following modification, for example, may be implemented.

Although in the present embodiment, an electrical connecting device which is connected to a to-be-connected housing element after being inserted into a roof hole of an automobile is described, the present invention can be applied in the same manner to a hole that is provided in a place other than the roof. In addition, the present invention can be applied in the same manner even in the case where the electrical connecting device is inserted into a hole that is provided in things other than automobiles. In addition, the present invention can be applied in the case where a connection work is carried out within a limited space, for example, work in a narrow space, without being limited to a case where the electrical connecting device is inserted into a hole.

Although in the present embodiment, the electrical connecting device is described as being used for coaxial wires, the present invention can be applied to wires other than coaxial wires.

Although the above-described embodiment is described by citing, as an example, a case where bent parts of connection terminals are formed to a right angle, they may not necessarily be bent in a right angle. The bent parts may be formed, for example, so as to be bent at two stages each of which is approximately 45 degrees.

The forms of the terminal supporting parts and the wire supporting parts, which are provided in the connecting housing element, may not be the same as in the above-described embodiment. That is, the terminal supporting parts may be in other forms as long as the terminal connecting parts are aligned in rectilinear form so as to be connectable to the to-be-connected terminals and the wire supporting parts may be in other forms as long as they support wires in a manner where the wires are arranged in the direction parallel to the direction in which the terminal connecting parts are arranged in rectilinear form. In addition, the wire supporting parts may not be provided in the case where wires are arranged between the connecting housing element and the cover element in the direction parallel to the direction in which the terminal connecting parts are arranged in rectilinear form.

Although the electrical connecting device that is connected to the connecting housing element for supporting to-be-connected terminals of four poles is described in the above embodiment, the present invention can be applied to a case of five or more poles. In addition, a variety of arrangement forms can be selected for wires which are arranged inside the rounded lid portion of the cover element without being limited to the stacked arrangement in step form that is described in the above embodiment.

Although the end on the front end side of the cover element that is formed in a cross form in the cross section perpendicular to the direction toward the front end side is described in the above embodiment, the end may not necessarily have this form. The form of the end on the front end side in the cross section may, for example, be in point symmetric form or linear symmetric form other than cross form. Point symmetric form or linear symmetric form other than cross form include, for example, radial form other than cross form, polygonal form of which the number of corners is an even number (such as hexagonal form), circular form (the end is formed in cone form or dome form) and the like. In addition, linear symmetric form may be polygonal form of which the number of corners is an odd number (such as pentagonal form). Here, the end may be in a form other than point symmetric form or linear symmetric form in the cross section and may be formed so as to be tapered toward the front end side.

(Second Embodiment)

Figure 11:
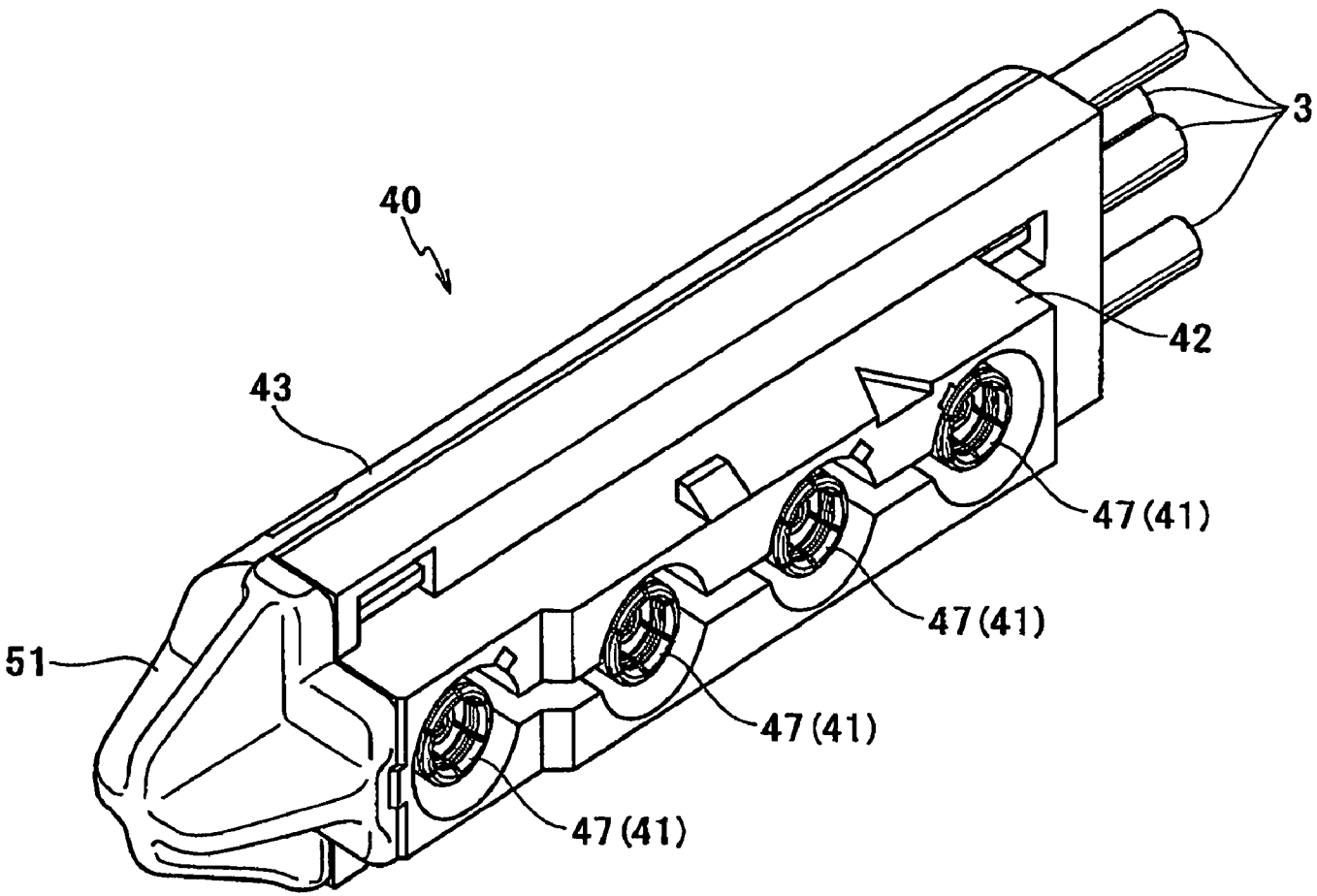
FIG. 11 is a perspective view illustrating an electrical connecting device according to the second embodiment of the present invention.

FIG. 11 is a perspective view illustrating an electrical connecting device 40 according to the second embodiment of the present invention which is connected to coaxial wires 3 of four poles (four wires) (hereinafter referred to as wires 3) and is connected to a to-be-connected housing element, not shown. This electrical connecting device 40 is connected to a to-be-connected housing element (not shown) to which coaxial wires of four poles (four wires) have been connected in the same manner as in the case of the first embodiment (see FIG. 1 and FIG. 2). In addition, in the same manner as in the case of the first embodiment, the electrical connecting device is used as a relay connector which is utilized in a variety of complex antennas that are attached to automobiles, such as, for example, an AM/FM antenna, a cellular antenna, a GPS (Global Positioning System) antenna, an SDARS (Satellite Digital Audio Radio System) antenna, an ETC antenna and a VICS antenna. Thus, this electrical connecting device 40 is connected to a to-be-connected housing element, not shown, after being inserted into a roof hole 6 that is provided in a roof 5 of an automobile of which a portion is illustrated in FIG. 1.

In FIG. 11, in the same manner as electrical connecting device 1 of the first embodiment, electrical connecting device 40 is provided with connection terminals 41 of four poles (four pieces) which are, respectively, connected to the ends of four wires 3, a connecting housing element 42 that is engaged with and connected to a to-be-connected housing element, not shown, and a cover element 43 that is attached connecting housing element 42.

Figure 12:
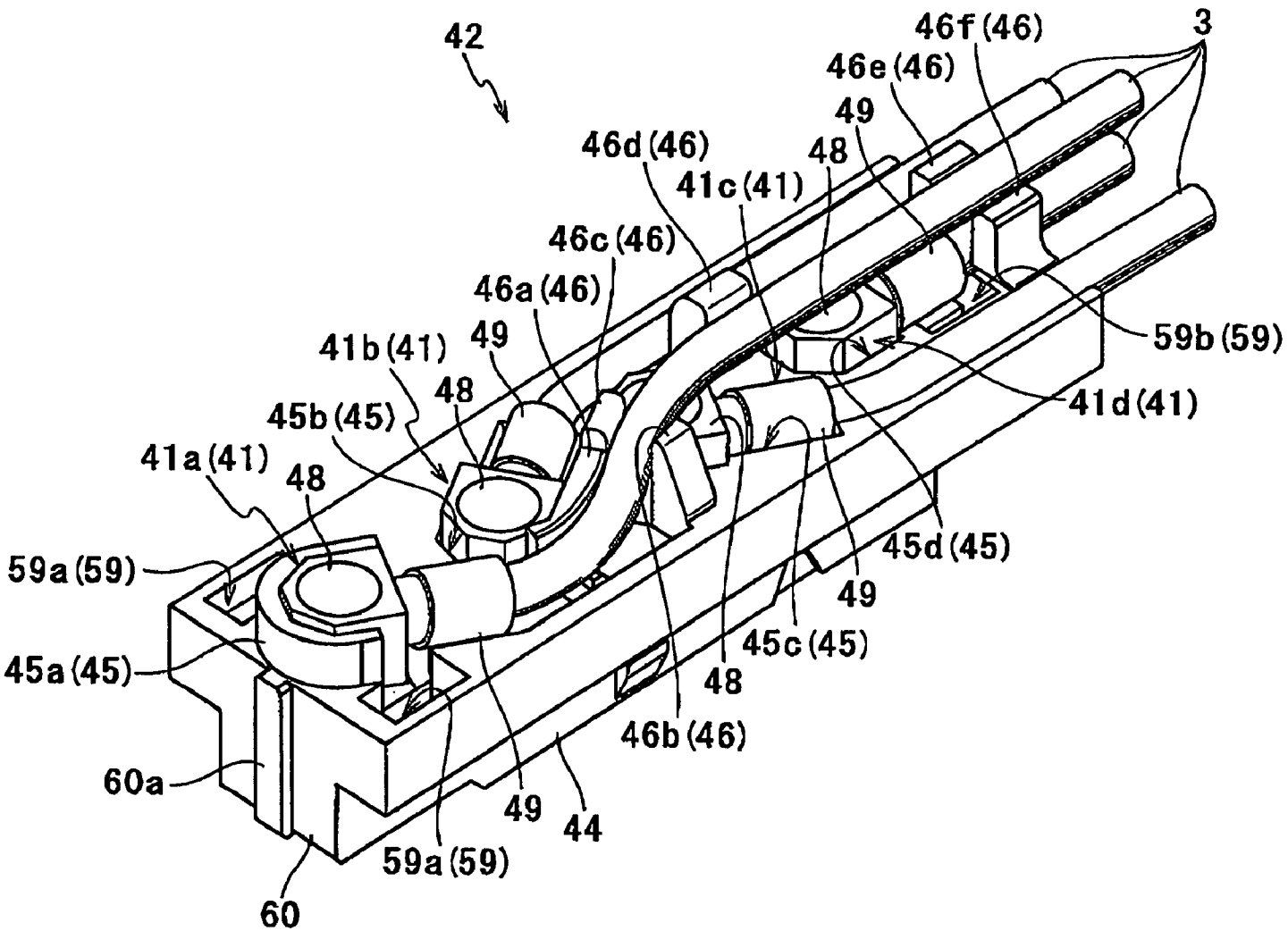
FIG. 12 is a perspective view showing the connecting hosing element in the electrical connecting device shown in FIG. 1.

FIG. 12 is a perspective view showing connecting housing element 42 in a state where connection terminals 41 (41*a* to 41*d*) of four poles that have been connected to wires 3 are attached to connecting housing element 42. Connection terminals 41 are formed in the same manner as connection terminals 11 according to the first embodiment and are provided with terminal connecting parts 47 (see FIG. 11), bent parts 48 and wire connecting parts 49. Connecting housing element 42 is also formed in the same manner as connecting housing element 12 according to the first embodiment, and terminal supporting parts 45 (45*a* to 45*d*) and wire supporting parts 46 (46*a* to 46*e*) are formed on a body portion 44. As a result, respective connection terminals 41 are supported by respective terminal supporting parts 45 in a manner where respective terminal connecting parts 47 of respective connection terminals 41 are aligned in rectilinear form. In addition, respective wires 3 are supported in a manner where wires 3 which are connected to wire connecting parts 49 of respective connection terminals 41 are arranged in the direction parallel to the direction in which terminal connecting parts 47 are arranged in rectilinear form.

Figure 13:
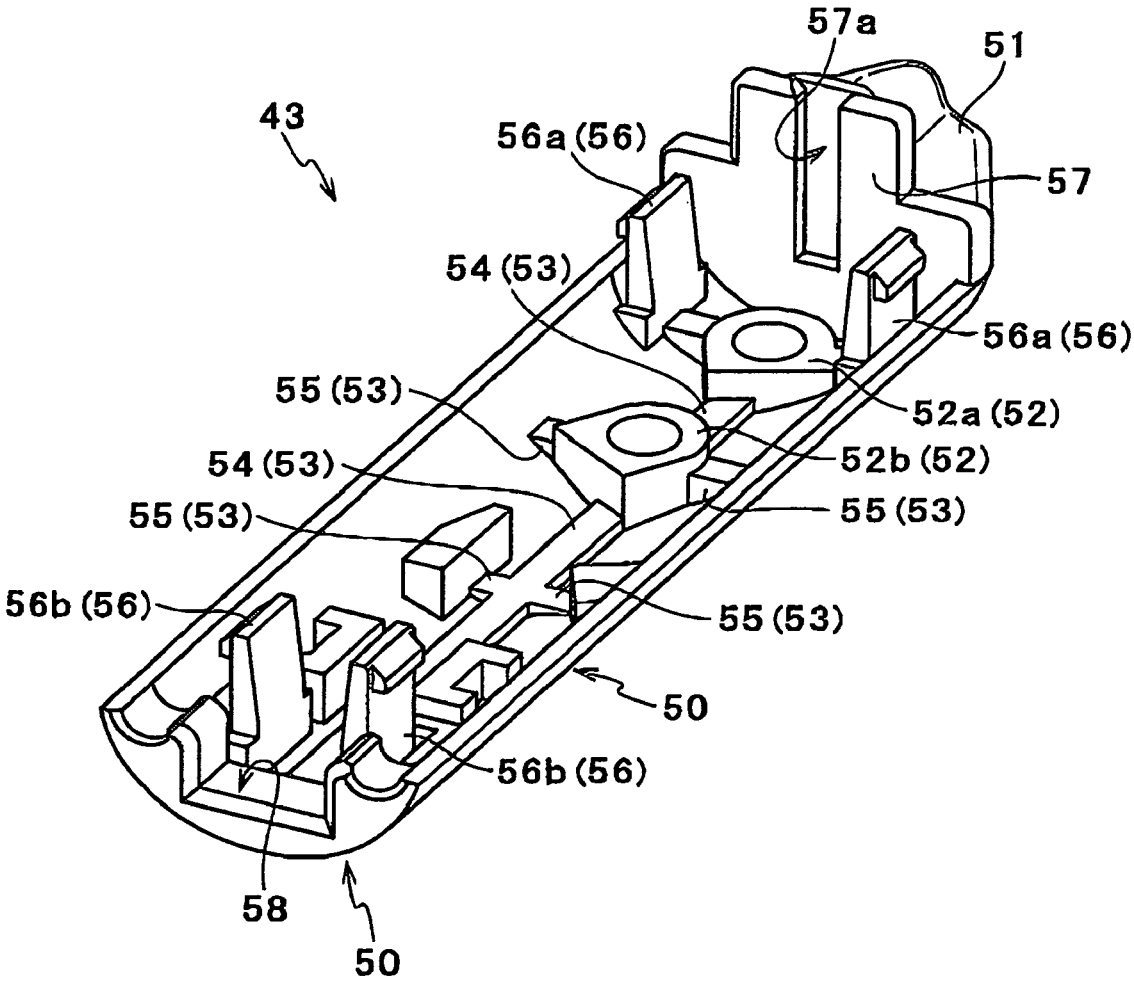
FIG. 13 is a perspective view of the cover element in the electrical connecting device shown in FIG. 1.

FIG. 13 is a perspective view showing a cover element 43 of which the side that is to be attached to connecting housing element 42 faces upward. Cover element 43 is attached to connecting housing element 42 so as to cover connection terminals 41 (see FIG. 11). This cover element 43 is provided with a rounded lid portion 51 that is formed to be in circular arc form in the cross section perpendicular to the direction in which wires 3 are arranged in a parallel manner by means of wire supporting parts 46 of connecting housing element 42. Respective wires 3 are stacked in step form so as to be arranged in chevron form and in grid form in connecting housing element 42 in the same manner as in the case of the first embodiment, and cover element 43 is attached to connecting housing element 42 and thereby, wires 3 are densely arranged inside rounded lid portion 51.

In addition, in the same manner as cover element 13 of the first embodiment, cover element 43 is formed, as shown in FIG. 11 and FIG. 13, in a manner where an end 51 on the front end side that is opposite the side from which wires 3 lead out from this cover element 43 (end that becomes a leading end at the time when electrical connection element 40 is inserted into roof hole 6) is tapered toward the front end side and is formed in a cross form. Here, an opening 58 through which wires 3 pass is created in the rear front end side which is opposite the front end side and from which wires 3 lead out from this cover element 43. As described above, the form of the end on the rear front end side from which wires 3 lead out and the form of end 51 on the front end side opposite the rear front end side are different from each other in cover element 43 in the same manner as in cover element 13 of the first embodiment.

In addition, reinforcing parts 53 are partially formed as thick portions of rounded lid part 50. Reinforcing parts 53 are formed so as to be provided with first reinforcing parts 54 and second reinforcing parts 55. First reinforcing parts 54 are formed on the inner side of rounded lid part 50 as ribs which protrude toward connecting housing element 42 to which cover element 43 is attached. In addition, these first reinforcing parts 54 are formed in rectilinear form in the direction parallel to the direction in which terminal connecting parts 47 in connecting housing element 42 to which cover element 43 is attached are arranged in rectilinear form. That is, the ribs that form first reinforcing parts 54 are arranged in rectilinear form in the longitudinal direction of cover element 43.

Meanwhile, second reinforcing parts 55 are also formed on the inner side of rounded lid part 50 as ribs which protrude toward connecting housing element 42 to which cover element 43 is attached, in the same manner as first reinforcing parts 54. In addition, these second reinforcing parts 55 are formed so as to be arranged along the cross section of rounded lid part 50 perpendicular to the direction in which terminal connecting parts 47 are arranged in rectilinear form in connecting housing element 42 to which cover element 43 is attached (that is, the cross section perpendicular to the longitudinal direction of cover element 43 in rounded lid part 50). Here, second reinforcing parts 55 are arranged so as to cross first reinforcing parts 54; where these intersecting portions are formed so as to be integrated. As described above, reinforcing parts 53 are arranged so as to function as a frame, which makes it easy to maintain the form of cover element 43.

In addition, restricting parts 52 (52*a* and 52*b*) for restricting movement of connection terminals 41 toward the cover element 43 side between connecting housing element 42 and cover element 43 at the time when this cover element 43 is attached to this connecting housing element 42 are formed so as to protrude from a number of places in cover element 43. Restricting part 52*a* restricts movement of connecting terminal 41*a* by making contact with this connection terminal 41*a*, and restricting part 52*b* restricts movement of connection terminal 41*b* by making contact with this connection terminal 41*b*. In addition, the number of restricting parts 52 (52*a* and 52*b*) are formed so as to be integrated with rounded lid part 50, and are formed so as to be integrated by means of reinforcing parts 53 (first reinforcing parts 54).

In addition, protrusions 56 (56*a* and 56*b*) that form a locking mechanism on the cover element 43 side at the time when cover element 43 is attached to connecting housing element 42 are provided on cover element 43. These protrusions 56 (56*a* and 56*b*) are formed so as to protrude toward connecting housing element 42 to which cover element 43 is attached. In addition, protrusion 56*a* is placed on the edge side, which is the side where end 50 is formed, while, protrusion 56*b* is placed on the rear front end side, which is the side where an opening 58 is provided.

In addition, as shown in FIG. 12, connecting housing element 42 is provided with holes 59 (59*a* and 59*b*) for locking the form part of a locking mechanism on this connecting housing element 42 side. Holes 59 for locking are created as through holes, and protrusions 56 are engaged in these holes 59 for locking at the time when cover element 43 is attached to to-be-connected housing element 42. In addition, protrusion 56*a* is engaged in hole 59*a* for locking, and protrusion 56*b* is engaged in hole 59*b* for locking. Here, engaging protrusions are provided on protrusions 56 so as to protrude to the outside (see FIG. 13), so that the engaging protrusions engage in engaging recesses (not shown) created inside holes 59 for locking. These engagements make connection in the locking mechanisms between protrusions 56 and holes 59 for locking, and thus, cover element 43 can be held (locked) to connecting housing element 42 without fail.

Protrusions 56 of cover element 43 are provided on the inner side of rounded lid part 50, and are not exposed from the side of connecting housing element 42 at the time when cover element 43 is attached to connecting housing element 42. In addition, these protrusions 56 are adjusted to a length which prevents the protrusions from protruding from holes 59 for locking. As a result, damage to a protrusion 56 caused by interference of the protrusion with the outside (for example, damage to a protrusion 56 caused by interference of the protrusion with the edge portion of roof hole 6 when electrical connecting device 40 is inserted into roof hole 6) can be prevented at the time when cover element 43 is attached to connecting housing element 42.

In addition, as shown in FIG. 13, a groove 57*a* in rectilinear form is created in a wall 57 on the front end side that is provided so as to support end 51 of cover element 43. Meanwhile, as shown in FIG. 12, a protrusion 60*a* in rectilinear form, which can be engaged with groove 57*a*, is formed on a wall 60 that makes contact with wall 57 on the front end side when cover element 43 is attached to connecting housing element 42. Thus, cover element 43 can be attached to contacting housing element 42 in a manner where groove 57*a* and protrusion 60*a* are made to make contact and are engaged with each other. As a result, it becomes easy to position the front end side of cover element 43 at an appropriate position relative to connecting housing element 42 when cover element 43 is attached to connecting housing element 42. Therefore, cover element 43 can be prevented from being attached to connecting housing element 42 in a state where the cover element 43 is shifted in the direction of the width. In addition, groove 57*a* that has been created so as to extend in rectilinear form and protrusion 60*a* in rectilinear form are engaged with each other when cover element 43 is attached to connecting housing element 42, and therefore, cover element 43 can be prevented from rotating in the direction of twisting relative to the longitudinal direction of the cover element 43 at the time of attachment of the cover element 43 and damage to the cover element 43 due to such a rotation can also be prevented.

In the above-described electrical connecting device 40, in the same manner as in the case of the first embodiment, respective wires 3 are arranged so as to be bundled in the direction parallel to the direction in which terminal connecting parts 47 are arranged in rectilinear form and can be efficiently arranged on the inner side of rounded lid part 50 in circular arc form. Therefore, the space for arranging wires 3 can be densely provided on the inner side of rounded lid part 50 and an increase in the size of the electrical connecting device caused by the pitch with which terminal connecting parts 47 are aligned, can be prevented, and thus, miniaturization of the electrical connecting device can be achieved.

In addition, in electrical connecting device 40, the region inside rounded lid part 50 is effectively used in a manner where reinforcing parts 54, which are thick portions of rounded lid part 50, can be partially provided in places which are not interfered by wires 3 and connection terminals 41 that are placed inside rounded lid part 50. Therefore, strength of rounded lid part 50 can be increased while miniaturization of cover element 43 is hardly hindered.

In addition, in electrical connecting device 40, the rib (first reinforcing part 54) in rectilinear form is formed on the inner side of rounded lid part 50, and thereby, the reinforcing part for increasing strength of rounded lid part 50 can be implemented in a simple configuration. In addition, the lid that forms firstly enforcing part 54 is formed in rectilinear form in the longitudinal direction of cover element 43, and therefore, strength against twisting of cover element 43 in the longitudinal direction can be increased.

In addition, in electrical connecting device 40, the rib that forms second reinforcing part 55 is formed so as to be arranged along the cross section of rounded lid part 50 that is perpendicular to the longitudinal direction of cover element 43, and therefore, strength against twisting of cover element 43 in the longitudinal direction can be increased.

In addition, in electrical connecting device 40, a number of restricting parts 52 are integrally formed by means of reinforcing part 53 (first reinforcing part 54), and therefore, a number of restricting parts 52 can be effectively utilized as portions of this reinforcing part 53.

Although the second embodiment of the present invention is described above, modifications and applications will naturally be clarified by reading and understanding the present specification, and such modifications and applications as are included in the claims, as well as equivalent meanings to the claims, are all intended to be included in the scope of the present invention. Modifications which are, for example, the same as those described in the first embodiment can be implemented.

INDUSTRIAL APPLICABILITY

As is clear from the above description, an electrical connecting device according to the present invention is particularly applicable to the case where the electrical connecting device is used so as to be connected to a to-be-connected housing element after being inserted into a hole provided for the insertion of wires between the inside and outside of the automobile. However, broader applications, in addition to this application, are possible for the present invention, and the present invention can be applied in a number of different environments and for a variety of purposes.

The invention claimed is:

1. An electrical connecting device for connecting a to-be-connected housing element that supports to-be-connected terminals arranged in substantially rectilinear form, comprising:

a connecting housing element having terminal supporting parts arranged in substantially rectilinear form;

connection terminals disposed on the connecting housing element, wherein the connection terminals respectively, comprise:

terminal connecting parts disposed in the terminal supporting parts and configured to electrically connect the to-be-connected terminals, wire connecting parts configured to connect wires extending along a surface of the connecting housing element at ends on the side opposite the terminal connecting parts, and bent parts disposed between the terminal connecting parts and the wire connecting parts; and a cover element configured to be attached to the connecting housing element so as to cover the connection terminals, wherein the wires are supported between the connecting housing element and the cover element, and wherein the cover element has a rounded lid part formed in an arcuate shape in cross section perpendicular to the direction in which the wires extend.

2. The electrical connecting device according to claim 1, wherein the bent parts are formed so as to be bent at a right angle.

3. The electrical connecting device according to claim 1, wherein the connecting housing element further comprises wire supporting parts for supporting respective wires that are connected to the wire connecting parts so that the wires are arranged in a direction in which the terminal connecting parts are arranged in rectilinear form.

4. The electrical connecting device according to claim 1, wherein the front end and the rear end of the cover element are formed in different shapes each other.

5. The electrical connecting device according to claim 1, being used as an electrical connecting device which is connected to the to-be-connected housing element after being inserted into a hole provided for insertion of wires between the inside and outside of an automobile.

6. The electrical connecting device according to claim 1, wherein the cover element further comprises a restricting part configured to restrict movement of the connection terminals.

7. The electrical connecting device according to claim 6, wherein the restricting part is formed so as to protrude toward the connecting housing element to which the cover element is attached and make contact with the connection terminals.

8. The electrical connecting device according to claim 6, wherein the cover element further comprises a reinforcing part which is a thick portion of the rounded lid part, wherein a plurality of restricting parts are disposed on the cover element, and wherein the plurality of restricting parts are formed so as to be integrated by means of the reinforcing part.

9. The electrical connecting device according to claim 1, wherein an front end of the cover element is formed in a tapered shape.

10. The electrical connecting device according to claim 9, wherein the front end of the cover element is formed in either a point symmetric shape or a linear symmetric shape.

11. The electrical connecting device according to claim 9, wherein the front end of the cover element is formed in a cross shape in cross section.

12. The electrical connecting device according to claim 1, wherein the cover element further comprises a reinforcing part which is a thick portion of the rounded lid part.

13. The electrical connecting device according to claim 12, wherein the reinforcing part further comprises a second reinforcing part which is formed as a rib, wherein the second reinforcing part is arranged on an inner surface of the rounded lid part in a direction perpendicular to the direction in which the terminal connecting parts are arranged.

14. The electrical connecting device according to claim 12, wherein the reinforcing part comprises a first reinforcing part which is formed as a rib.

15. The electrical connecting device according to claim 14, wherein the first reinforcing part is formed in rectilinear form in a direction in which the terminal connecting parts are arranged.

* * * * *